United States Patent [19]

Hayashi et al.

[11] Patent Number: 4,601,594

[45] Date of Patent: Jul. 22, 1986

[54] ENDLESS INK RIBBON CASSETTE HAVING SELECTIVE RIBBON TENSION CONTROL

[75] Inventors: Mikio Hayashi; Fumio Otsuka, both of Tokyo, Japan

[73] Assignee: Seikosha Co., Ltd., Tokyo, Japan

[21] Appl. No.: 565,184

[22] Filed: Dec. 23, 1983

[30] Foreign Application Priority Data

Dec. 24, 1982 [JP] Japan ..... 57-200225[U]
Dec. 27, 1982 [JP] Japan ..... 57-201630[U]

[51] Int. Cl.[4] ..... B41J 32/02

[52] U.S. Cl. ..... 400/196.1; 400/201; 400/202.4; 400/234; 400/235; 400/240.4

[58] Field of Search ..... 400/194, 195, 196, 196.1, 400/201, 202 A, 207, 208, 208.1, 234, 235, 235.1, 240.4; 242/75.2, 55.19, 199

[56] References Cited

U.S. PATENT DOCUMENTS

| | | | |
|---|---|---|---|
| 2,838,250 | 6/1958 | Stavrakis et al. | 242/75.2 X |
| 3,758,012 | 9/1973 | Bonner et al. | 400/195 X |
| 4,071,133 | 1/1978 | Scherrer et al. | 400/196 |
| 4,290,567 | 9/1981 | Saito | 242/199 X |
| 4,304,374 | 12/1981 | Okamura et al. | 242/199 |
| 4,394,989 | 7/1983 | Moris | 242/55.19 A |
| 4,397,574 | 8/1983 | Wojdyla | 400/235.1 X |
| 4,406,553 | 9/1983 | Nally et al. | 400/208 |
| 4,407,595 | 10/1983 | Gershnow | 400/208 |

FOREIGN PATENT DOCUMENTS

| | | | |
|---|---|---|---|
| 2509226 | 1/1983 | France | 400/208 |
| 0132581 | 8/1983 | Japan | 400/201 |
| 0134775 | 8/1983 | Japan | 400/201 |
| 7706427 | 12/1977 | Netherlands | 400/196.1 |

OTHER PUBLICATIONS

IBM Technical Disclosure Bulletin, "Molded Ribbon Cartridge with Brake", Craft, vol. 25, No. 12, May 1983, pp. 6676–6677.

*Primary Examiner*—Ernest T. Wright, Jr.
*Attorney, Agent, or Firm*—Robert E. Burns; Emmanuel J. Lobato; Bruce L. Adams

[57] ABSTRACT

An ink ribbon cassette for a printer includes a ribbon storage chamber in which an endless ink ribbon is stored. The ribbon has a portion lying outside the chamber, and is movable out of and into the chamber by a feed roller. A roller is provided in the vicinity of the ribbon outlet of the chamber. A spring is provided adjacent to the chamber for holding the ribbon against the roller to impart tension to the outwardly lying ribbon portion. A lever contacts the spring, and is rotatable to deform the spring so that the spring may hold the ribbon against the roller with an increased force.

4 Claims, 6 Drawing Figures

ENDLESS INK RIBBON CASSETTE HAVING SELECTIVE RIBBON TENSION CONTROL

BACKGROUND OF THE INVENTION

1. Field of the Invention

This invention relates to an ink ribbon cassette for a printing head in a printer.

2. Description of the Prior Art

There is known an ink ribbon cassette having a ribbon storage chamber from which an endless ink ribbon is drawn out, and into which it is retracted by a feed roller. A printing head faces a platen, and is slightly spaced apart therefrom. When the ribbon cassette is set for the printing head, the ribbon portion lying outside the cassette is inserted into the small clearance between the printing head and the platen so as to face the front surface of the printing head. It is, however, often the case that the ink ribbon is caught by the front surface of the printing head, and twisted, and when it is untwisted and straightened by the operator's fingers, the fingers become stained with ink.

SUMMARY OF THE INVENTION

It is an object of this invention to provide an improved ink ribbon cassette which is free from the drawbacks of the prior art as hereinabove pointed out.

The ribbon cassette of this invention is particularly featured by including a spring for imparting tension to the ink ribbon outside the cassette, and a lever supported rotatably for deforming the spring to increase the force which the spring exerts on the ink ribbon. The cassette can be attached and set easily in the printer without any ink contamination of the fingers.

DETAILED DESCRIPTION OF THE INVENTION

Figure 1:
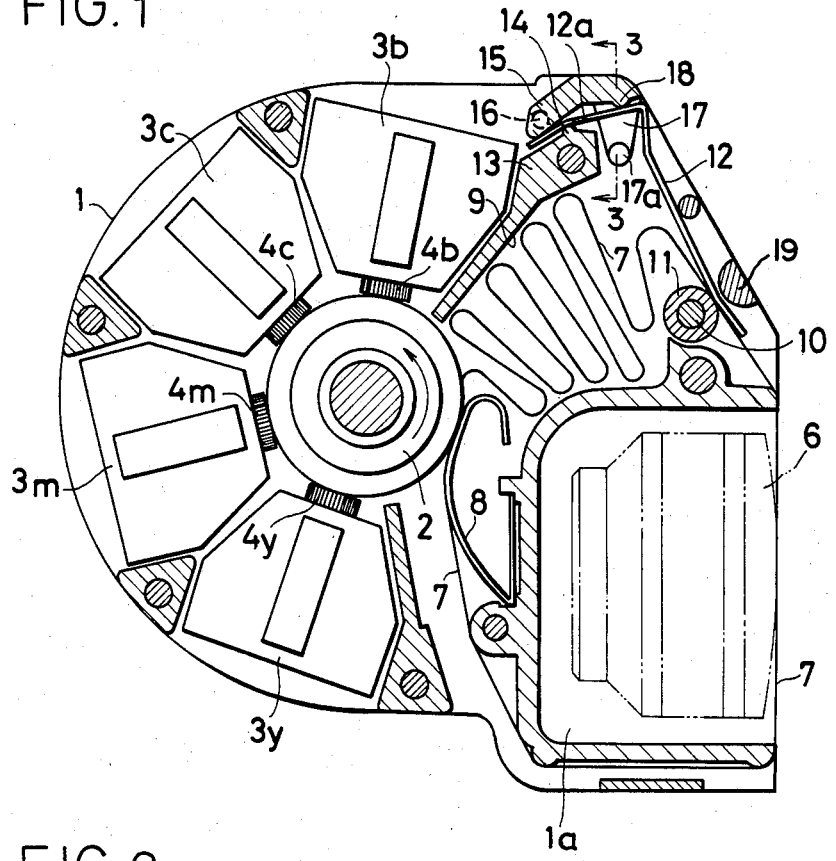
FIG. 1 is a cross sectional view of an ink ribbon cassette embodying this invention.
Figure 2:
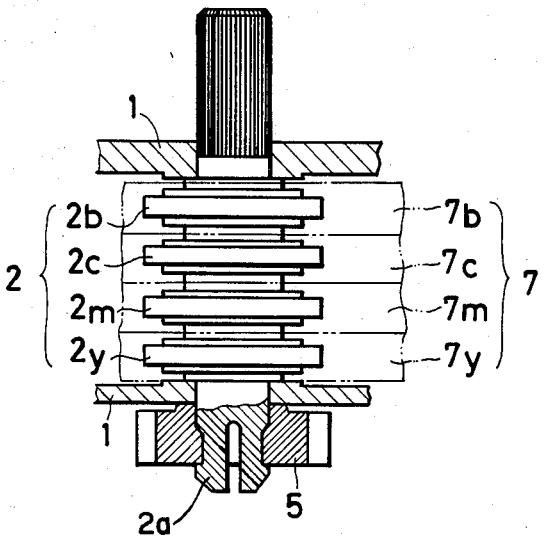
FIG. 2 is a fragmentary sectional view showing a feed roller.
Figure 3:
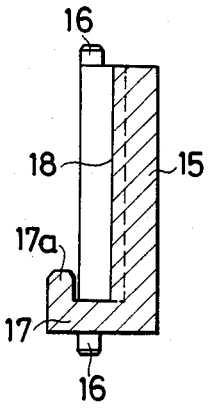
FIG. 3 is an enlarged sectional view taken along the line 3—3 of FIG. 1, and showing a lever.

Referring first to FIG. 1 of the drawing, an ink ribbon cassette embodying this invention includes a casing 1 having a recess 1*a* in which a printing head 6 is received. A feed roller 2 is rotatably supported in the center of the casing 1. Four ink cartridges 3*b*, 3*c*, 3*m* and 3*y* containing black, cyan, magenta and yellow inks, respectively, are disposed radially about the feed roller 2. The feed roller 2 has four coaxially formed ink transfer surfaces 2*b*, 2*c*, 2*m* and 2*y*, as shown in FIG. 2. The ink cartridges 3*b*, 3*c*, 3*m* and 3*y* have inking members 4*b*, 4*c*, 4*m* and 4*y* which contact the ink transfer surfaces 2*b*, 2*c*, 2*m* and 2*y*, respectively. The feed roller 2 has a shaft projection 2*a* which extends outwardly through the bottom wall of the casing 1, and to which a gear 5 is secured. If the ribbon cassette is set on a carriage (not shown) carrying the printing head 6, and if the carriage is moved, the gear 5 is rotated to rotate the feed roller 2 counterclockwise in FIG. 1. An ink ribbon 7 has black, cyan, magenta and yellow zones 7*b*, 7*c*, 7*m* and 7*y*, as shown in FIG. 2, which are held against the ink transfer surfaces 2*b*, 2*c*, 2*m* and 2*y*, respectively, of the feed roller 2 by a spring 8 which is shown in FIG. 1. The ink ribbon 7 is endless, and is for the greater part stored in a ribbon storage chamber 9. If the feed roller 2 is rotated, the ribbon 7 is displaced lengthwise and drawn into the ribbon storage chamber 9, while at the same time, it is drawn out of the chamber 9. The casing 1 is provided with a shaft 10 in the vicinity of the ribbon outlet of the chamber 9, and a roller 11 is rotatably supported on the shaft 10. The ink ribbin 7 is held against the roller 11 by a spring plate 12 so that the spring plate 12 may impart tension to the ink ribbon 7 leaving or exiting the chamber 9. The spring plate 12 is generally L-shaped as shown in FIG. 1, and has a base portion 12*a*. The casing 1 has a dividing wall 13 which defines the ribbon storage chamber 9. The wall 13 has a projection 14 on one side thereof. A manually operable lever 15 is provided adjacent to the projection 14, and has a shaft 16 secured to the casing 1 so that the lever 15 may be turned about the shaft 16. The lever 15 has a tongue 17 projecting from its lower end, and terminating in a projection 17*a*, as shown in FIG. 3. The lever 15 is turnable clockwise as viewed in FIG. 1 until the projection 17*a* abuts on the end face of the wall 13. The lever 15 has another projection 18 facing the base portion 12*a* of the spring plate 12. The base portion 12*a* is disposed between the wall 13 and the lever 15. The projection 14 on the wall 13 contacts the base portion 12*a* of the spring plate 12 on one side thereof, while the shaft 16 and the projection 18 of the lever 15, which are located on the opposite side of the wall projection 14 from each other, contact the other side of the base portion 12*a*. Thus, the base portion 12*a* is held in position unless it is pulled out by a force exceeding the clamping force of the wall 13 and the lever 15.

Figure 4:
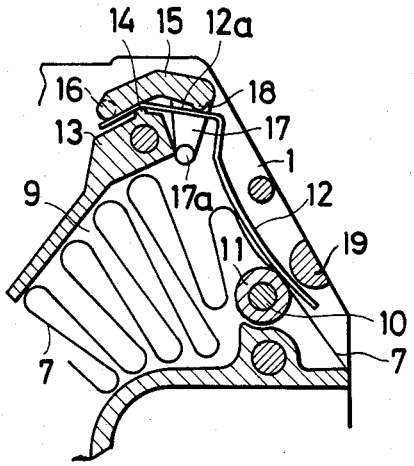
FIG. 4 is a fragmentary sectional view showing the lever rotated into its operative position.

When the cassette is set in a printer, the casing 1 is manually held by the operator's hand, and the lever 15 is pressed by a finger into rotation against the force of the spring plate 12, as shown in FIG. 4. The base portion 12*a* the spring plate 12 is bent at the wall projection 14 so that the spring plate 12 may hold the ribbon 7 against the roller 11 with an increased force. The increased force disables the rotation of the roller 11, and increases the friction between the ink ribbon 7 and the roller 11 to the extent that the ink ribbon 7 does not move unless it is pulled out forcibly. The ink ribbon 7 lying outside the ribbon cassette is held under tension in front of the recess 1*a*, and can be properly positioned in front of the printing head 6 without getting twisted when the cassette is set in the printer.

Figure 5:
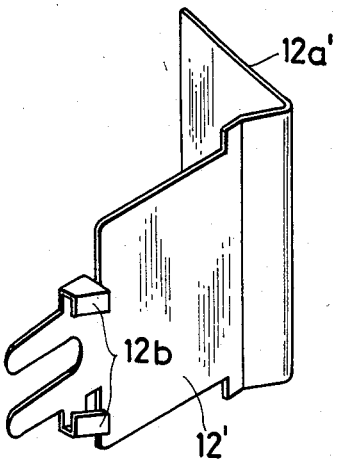
FIG. 5 is an enlarged perspective view of a spring in another ribbon cassette embodying this invention.
Figure 6:
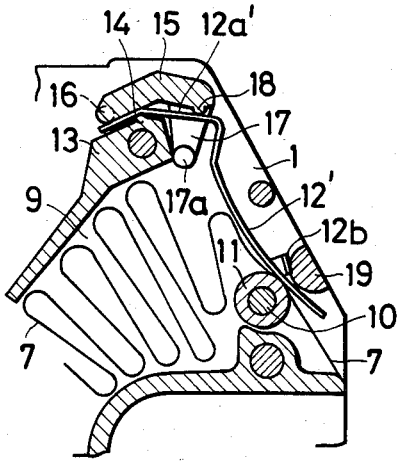
FIG. 6 is a fragmentary sectional view showing a lever rotated into its operative position in conjunction with the spring shown in FIG. 5.

Another ribbon cassette embodying this invention is fragmentarily shown in FIGS. 5 and 6, and featured by a modified spring plate 12'. The spring plate 12' has a pair of wedge projections 12*b* formed at an end remote from its base portion 12*a'* and in the vicinity of the roller 11. The casing 1 includes a pin 19 having a semicircular cross section and situated close to the projections 12*b*, as shown in FIG. 6. In all the other aspects, the ribbon cassette is identical in construction to the cassette as hereinabove described with reference to FIGS. 1 to 4. When the lever 15 is pressed into rotation against the force of the spring plate 12', the base portion 12*a'* of the spring 12' is bent at the wall projection 14, as shown in FIG. 6. The projections 12*b* abut on the pin 19, and their wedge effects create an increased force with which the spring plate 12' holds the ink ribbon 7 against the roller 11. This enables the temporary locking of the ink ribbon 7 and ensures the proper setting thereof, as hereinbefore described in detail. The spring plate 12' shown in FIGS. 5 and 6 may be formed with a particularly small thickness, since its projections 12*b* define a wedge located between the roller 11 and the pin 19 to lock the ink ribbon 7 under tension.

Although the invention has been described with reference to the preferred embodiments thereof, it is to be understood that modifications or variations may be easily made by anybody of ordinary skill in the art without departing from the scope of the invention which is defined by the appended claims. For example, it is possible to form the roller 11 as an integral part of the casing 1. The spring plate 12 can be secured in position in any other way if it ensures the proper locking of the ink ribbon 7.

What is claimed is:

1. An endless ink ribbon cassette comprising: a cassette casing; an endless ink ribbon stored in the casing and having a part thereof lying outside the casing; a member disposed in the vicinity where the ink ribbon exits the casing; a resiliently deformable spring plate resiliently pressing the ink ribbon against the member to apply a tensioning force thereto; a manually turnable locking lever operative when manually turned in a given direction to resiliently deform the spring plate to thereby increase the pressure at which the ink ribbon is pressed against the member; and an abutment stationarily disposed within the cassette casing; the spring plate including at least one wedge-shaped projection engageable with the abutment during resilient deformation of the spring plate to urge the spring plate and ink ribbon against the member.

2. An endless ribbon cassette according to claim 1; wherein the spring plate has opposed sides and is mounted in the casing so that one side thereof resiliently urges the ink ribbon against the member, the at least one wedge-shaped projection projecting from the other side of the spring plate at a location proximate to where the spring plate one side urges the ink ribbon against the member.

3. An endless ink ribbon cassette according to claim 1; wherein the spring plate has two wedge-shaped projections.

4. An endless ink ribbon cassette according to claim 1; wherein the member comprises a rotatably mounted roller.

* * * * *